United States Patent [19]

Bruckschlögl

[11] Patent Number: 4,745,866

[45] Date of Patent: May 24, 1988

[54] DEVICE FOR MOUNTING A BOW ON A REVOLVING CABLE OF A SKI LIFT AND BOW ASSEMBLY FOR A SKI LIFT

[76] Inventor: Max Bruckschlögl, Au 132, A-4823 Steeg, Austria

[21] Appl. No.: 33,751

[22] Filed: Apr. 3, 1987

[30] Foreign Application Priority Data

Apr. 25, 1986 [AT] Austria ..... 1122/86

[51] Int. Cl.[4] ..... B61B 11/00; B61B 12/00

[52] U.S. Cl. ..... 104/173.2

[58] Field of Search ..... 104/165, 173.1, 173.2

[56] References Cited

U.S. PATENT DOCUMENTS

| | | | |
|---|---|---|---|
| 3,147,713 | 9/1964 | Saiko et al. | 104/173.2 |
| 3,837,290 | 9/1974 | Dur | 104/173.2 |
| 3,868,907 | 3/1975 | Schippers | 104/173.2 |
| 4,246,848 | 1/1981 | Schneider | 104/173.2 |

FOREIGN PATENT DOCUMENTS

| | | | |
|---|---|---|---|
| 320020 | 1/1975 | Austria . | |
| 1272118 | 8/1961 | France | 104/173.2 |

*Primary Examiner*—George L. Walton

*Attorney, Agent, or Firm*—Collard, Roe & Galgano

[57] ABSTRACT

A device for mounting a bow (3) on a revolving cable (1) of a ski lift comprises a holder (2), to which the bow (3) is connected and which is mounted on the cable (1) for rotation about the axis of said cable. To permit a simple adjustment of the bow in height (3) to the user of the lift, the holder (2) carries a swivelarm (4), which protrudes from the cable (1) and has a free end, on which the bow (3) is mounted for rotation about an axis which is parallel to the cable (1). Said swivelarm is rotatable by means of a handle (8).

11 Claims, 2 Drawing Sheets

DEVICE FOR MOUNTING A BOW ON A REVOLVING CABLE OF A SKI LIFT AND BOW ASSEMBLY FOR A SKI LIFT

BACKGROUND OF THE INVENTION

1. Field of the Invention

This invention relates to a device for mounting a bow on a revolving cable of a ski lift, which device comprises a holder, which is connected to the bow and is mounted for rotation about the axis of the cable.

2. Description of the Prior Art

A bow, which is rigidly secured to the haulage cable of a ski lift, will exert a torsional moment on the cable. It is desired to avoid such a torsional moment, on the one hand, and to ensure that all bows will assume the same position relative to the sheaves around which the cable is reversed, on the other hand. From Austrian Patent Specification No. 320,020 it is known that this can be accomplished in that the holders connected to the bows are mounted on the cable for rotation about its axis. That rotatable mounting of the bows on the cable by means of the holders also permits a certain adaptation of the bow, which laterally protrudes from the cable, to the height of the user of the ski lift. But that adaptation is usually insufficient so that the cable is lifted by hand in order to change the bow in height. This requires the user of the ski lift to exert a substantial force and to take up part of the weight of the cable and of the load on the cable.

SUMMARY OF THE INVENTION

It is an object of the invention to avoid the disadvantages outlined hereinbefore and to provide an improved device for securing a bow to a revolving cable of a ski lift, which device permits the user of the ski lift to move the bow in a simple manner to the position which is most convenient for the user in such a manner that the course of the cable need not be altered.

This object is accomplished in accordance with the invention in that the holder carries a swivelarm, which protrudes from the cable, the bow is mounted on said arm at that end thereof which is remote from the cable and for rotation about an axis which is substantially parallel to the cable, and the bow is rotatable by means of a handle.

As the bow is not rigidly connected to the holder but is connected to it for rotation about an axis which is substantially parallel to the cable, the bow can be adjusted in height parallel to itself without a shifting of the cable in height because the elevation of the bow will be determined by the angular position of the protruding swivelarm carried by the holder. For this reason the user of the ski lift can use the handle to adjust the bow to the optimum position for dragging that user of the ski lift and the bow serves only to transmit to the user of the ski lift those traction forces which act in the direction of travel rather than also forces which are transverse to said direction.

A particularly simple design will be obtained within the scope of the invention if the bow is secured to one end of a shaft, which extends through and is rotatably mounted in a bearing bushing that is mounted on the swivelarm carried by the holder, and the handle is secured to the other end of the shaft. If the device is properly designed that shaft will extend approximately on the level of the underarm of a user of the ski lift when the bow is in dragging position. In that case the bow can be pivotally moved by the handle mainly by a rotation of the underarm about its longitudinal axis. In order to permit the user to hold his or her hand in a natural position for actuating the handle, the handle may extend at an angle to the bow with respect to the axis of rotation of the bow. Such an arrangement will ensure an optimum action of the force that is exerted to adjust the bow. Owing to the anatomical relationships, a desirable angle between the handle and the bow is in the range from 60° and 90°.

If the bow can be rotated against the force of a return spring from a position of rest, to which it has been swung in toward the holder, to a position in which the bow extends outwardly from the swivelarm, the release of the bow by the user after use will cause the bow to perform an inward pivotal movement to its position of rest, in which the bow extends toward the holder. In that position the holder will depend from the cable under the action of gravity because the holder is mounted to be freely rotatable about the axis of the cable. When the bow extends outwardly from the swivelarm, the bow will be spaced a relatively large distance from the cable. Nevertheless, when the bow has been swung in, the length of the device will not exceed the length of the arm.

DETAILED DESCRIPTION OF THE PREFERRED EMBODIMENT

Figure 1:
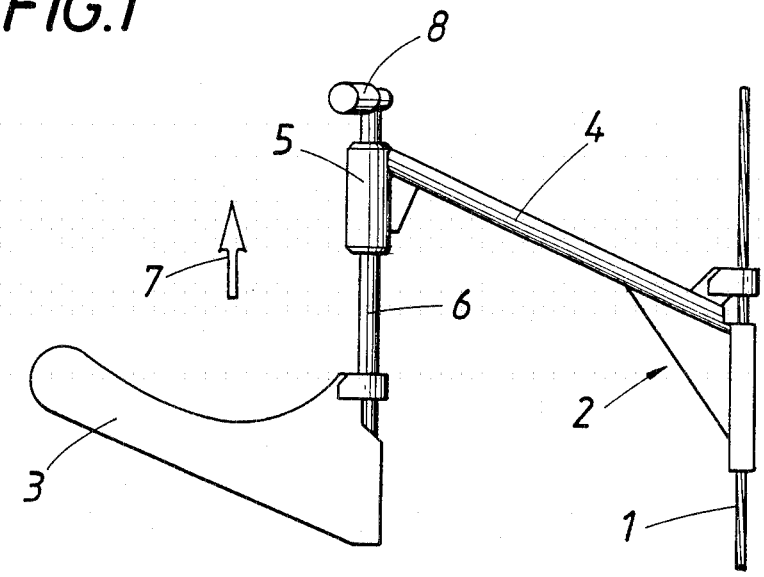
FIG. 1 is a top plan view showing a bow assembly comprising a device for mounting a bow on a revolving cable of the ski lift with that assembly in position of use.

An embodiment of the invention will now be explained in more detail with reference to the drawing.

Figure 2:
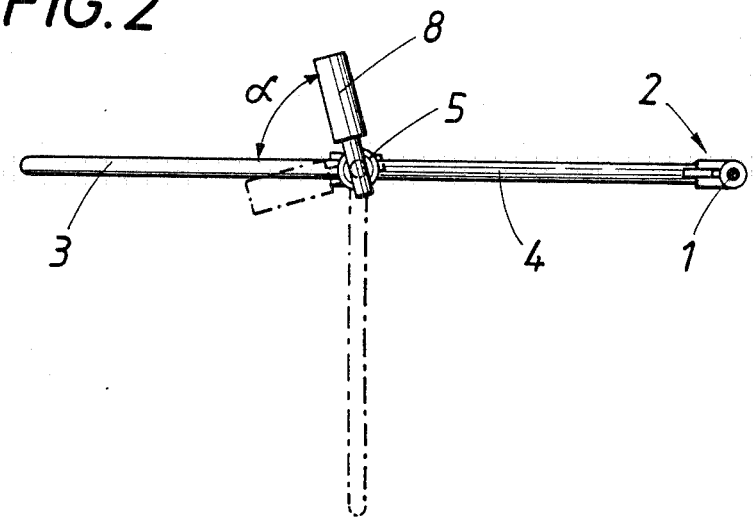
FIG. 2 is a front elevation showing that assembly.

The illustrated device comprises a holder 2, which is mounted on a revolving cable 1 of a ski lift for rotation about a first axis, which coincides with the axis of the cable. The holder 2 carries a bow 3. A difference from the known devices of that kind resides in that the bow 3 is not-rotatably connected to the holder 2 but is rotatably mounted on the outer end of a swivelarm 4, which is carried by the holder 2 and protrudes from the cable 1. On that outer end of the swivelarm 4 the bow 3 is mounted for rotation about a second axis, which is approximately parallel to the first axis. The swivelarm 4 is provided at its outer end with a bearing bushing 5. A shaft 6 extends through the bearing bushing 5 and is rotatably mounted therein. At that end of the shaft 5 which is the trailing end in the direction of travel, indicated by an arrow 7, the bow 3 is non-rotatably connected to the shaft 6. A handle 8 for rotating the bow 3 is secured to the leading end of the shaft 5. As is particularly apparent from FIG. 2 the handle 8 extends at an angle to the bow 3 with respect to the axis of rotation of the bow. That angle may desirably be in the range from 60 to 90 degrees and in the illustrated embodiment amounts to about 75 degrees. This will permit the user to hold his or her hand in a natural position to rotate the bow 3 to its position of use.

Figure 3:
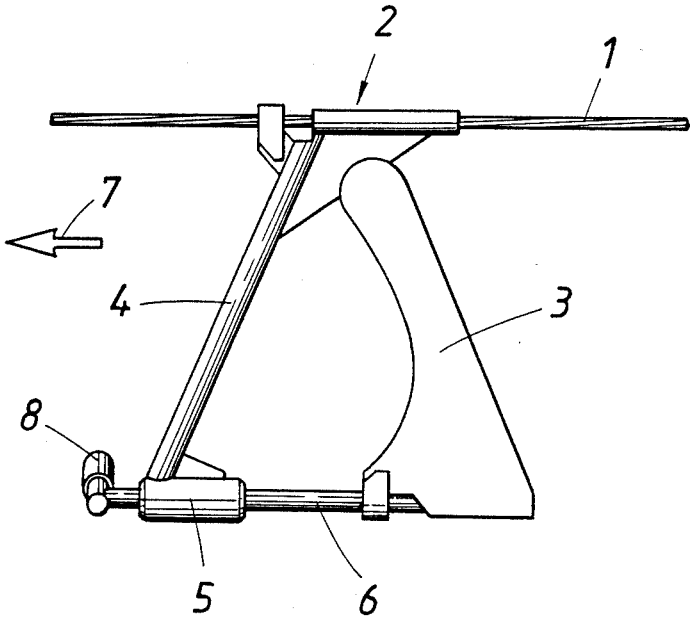
FIG. 3 is a side elevation showing the assembly in position of rest.

A spring, now shown, urges the bow 3 toward a position of rest, which is shown in FIG. 3 and in which the bow 3 extends inwardly toward the holder 2 and the holder depends from the cable 1 under gravity. Adjacent to the lower pulley for reversing the cable 1 of the ski lift, a suitable guide is provided for pivotally raising the swivelarm 4 to an approximately horizontal position and the bow 3 is simultaneously rotated to a depending position in which the handle 8 extends toward the waiting user of the ski lift. This is indicated in phantom in FIG. 2. The user of the ski lift then takes the handle 8 and actuates the same to turn the bow 3 to its position of use in which the bow 3 protrudes approximately horizontally from the arm 4 (see FIGS. 1 and 2). Because during the rotation of the handle 8 the shaft 6 is approximately parallel to the underarm of the user of the ski lift, the force exerted by the user of the ski lift will act in a desirable manner so that the actuation of the device is simple. The handle 8 can also be used to adjust the bow 3 in height without a need to shift the cable 1 because the bow 3 is pivoted to the swivelarm 4 and the swivelarm 4 is pivoted to the cable 1.

I claim:

1. In a device for mounting a bow on a revolving cable of a ski lift, comprising a holder, which defines a first axis and is adapted to be mounted on said cable for rotation about said first axis in a position in which said first axis coincides with the axis of said cable, and mounting means, which are carried by said holder and adapted to be connected to said bow, the improvement residing in that said mounting means comprise a swivelarm, which protrudes from said holder and has an outer end remote from said holder, and pivot means for pivotally connecting said bow to said swivelarm at said outer end about a second axis, which is approximately parallel to said first axis, and a handle is carried by said mounting means and adapted to be operatively connected to said bow and operable to pivotally move said bow about said second axis to allow a ski user to hold his or her hand on said handle in a natural position to rotate said bow to its position of use for easily adjusting said bow height without a need to shift said cable.

2. The improvement set forth in claim 1, wherein said pivot means comprise a bearing bushing mounted on said swivelarm at said outer end and centered on said second axis, and a shaft, which extends through and is rotatably mounted in said bearing bushing and has a first end provided with means for non-rotatably connecting said shaft to said bow and a second end which is non-rotatably connected to said handle.

3. The improvement set forth in claim 2, wherein said handle has a longitudinal axis and said shaft is provided with means for non-rotatably connecting said bow to said shaft in a position in which said bow extends at an angle to said longitudinal axis of said handle with respect to said second axis.

4. The improvement set forth in claim 1, wherein said handle has a longitudinal axis and said pivot means comprise means for non-rotatably connecting said bow to said handle in a position in which said bow extends at an angle to said longitudinal axis of said handle with respect to said second axis.

5. In a bow assembly adapted to be mounted on a revolving cable of a ski lift, comprising a bow, a holder, which defines a first axis and is adapted to be mounted on said cable for rotation about said first axis in a position in which said first axis coincides with the axis of said cable, and mounting means, which are carried by said holder and connected to said bow, the improvement residing in that said mounting means comprise a swivelarm which protrudes from said holder and has an outer end remote from said holder, and pivot means, which pivotally connect said bow to said swivelarm at said outer end about a second axis, which is substantially parallel to said first axis, and a handle is carried by said mounting means and operatively connected to said bow and operable to pivotally move said bow about said second axis to allow a ski user to hold his or her hand on said handle in a natural position to rotate said bow to its position of use for easily adjusting said bow height without a need to shift said cable.

6. The improvement set forth in claim 5, wherein said pivot means comprise a bearing bushing mounted on said swivelarm at said outer end and centered on said second axis and a shaft, which extend through and is rotatably mounted in said bearing bushing and has a first end that is non-rotatably connected to said bow and a second end that is non-rotatably connected to said handle.

7. The improvement set forth in claim 6, wherein said handle has a longitudinal axis and said bow extends at an angle to said longitudinal axis with respect to said second axis.

8. The improvement set forth in claim 7, wherein said bow extends at an angle from 60 to 90 degrees to said longitudinal axis with respect to said second axis.

9. The improvement set forth in claim 5, wherein said handle has a longitudinal axis and said bow extends at an angle to said longitudinal axis with respect to said second axis.

10. The improvement set forth in claim 9, wherein said bow extends at an angle from 60 to 90 degrees to said longitudinal axis with respect to said second axis.

11. The improvement set forth in claim 5, wherein said pivot means pivotally connect said bow to said swivelarm for a pivotal movement between a position of rest, in which said bow extends inwardly from said pivotal mounting means toward said holder, to a position of use, in which said bow extends outwardly from said pivot means, and spring means are provided, which urge said bow toward said position of rest.

* * * * *